United States Patent [19]

DiTullio

[11] Patent Number: 4,470,419

[45] Date of Patent: Sep. 11, 1984

[54] BRASSIERE

[75] Inventor: Flavia DiTullio, New York, N.Y.

[73] Assignee: Consolidated Foods Corp., Winston-Salem, N.C.

[21] Appl. No.: 551,637

[22] Filed: Nov. 14, 1983

[51] Int. Cl.[3] ..... A41C 1/06

[52] U.S. Cl. ..... 128/443

[58] Field of Search ..... 128/443, 444, 494, 498, 128/429

[56] References Cited

U.S. PATENT DOCUMENTS 1,979,120 10/1934 Robbins ..... 128/443

2,185,159 12/1939 Rubinstein ..... 128/498

3,157,182 11/1964 Fridolph ..... 128/429

3,353,540 11/1967 Erteszek ..... 128/489

*Primary Examiner*—Doris L. Troutman

*Attorney, Agent, or Firm*—Charles Y. Lackey; William S. Burden

[57] ABSTRACT

This invention provides improvements in brassieres which assure better support of and conformance to the wearer by flattening and streamlining the sides of the breast of a full-figured woman through the application of side panels of rigid or elastomeric fabrics. Each side panel includes a fabric component cut in the direction of the pull so that stress created when the side panels are tightened is evenly distributed along the side of the breast cup contiguous with the panels.

7 Claims, 4 Drawing Figures

BRASSIERE

BRIEF SUMMARY AND OBJECTS OF THE INVENTION

Brassieres generally comprise a frontal portion including two breast cups with some form of connection between the cups, side panels which extend from the outermost edges of the cups to form a body encircling band, and shoulder straps extending from adjacent the upper portion of each cup, over the shoulder of a wearer, and to the panels.

There are several types of panel constructions: those formed of nonstretchable fabrics, those of stretch fabrics and those of elastic fabrics. For purposes of this application, stretch fabrics are those which, due to the construction thereof, provide an elongation to the fabric at least in one direction upon the application of a force, but do not include elastic recovery features. In the present situation, "elastic" fabric relates to a fabric which includes an elastomer which distends upon the application of a given force and provides for rapid recovery upon removal of the force. Many elastics are two-way stretch fabrics having elastomers in both the longitudinal and vertical directions. Also, the term "rigid fabric" refers to those fabrics less flexible and having less elongation than an elastic fabric. The panels of the present invention may be of elastomeric or rigid fabric construction.

In the present invention the selective orientation of prescribed fabric components deters undesirable distortion and serves to evenly distribute stress along the side of the cup contiguous with a side panel, thus essentially flattening the tissue of the side of the breast.

A primary object of the invention is the provision of a new and improved brassiere construction which flattens and streamlines the sides of the breast of a full-figured woman.

Another object of the invention is the provision of a brassiere construction which provides attractive and comfortable support to a wearer.

Still another object of the invention is the provision of a brassiere which eliminates excessive strain or pull on the cups.

A further object of the invention is the provision of a novel construction wherein each brassiere cup is secured to a power net fabric in such a manner as to result in balanced tensions along the outer side of the cup.

Other objects and advantages of the invention will become apparent when considered in view of the following detailed description.

DETAILED DESCRIPTION OF THE INVENTION

Figure 1:
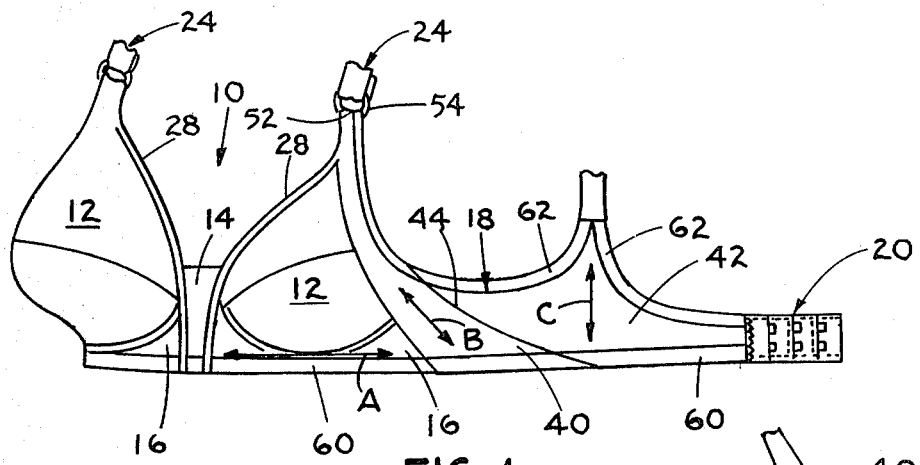
FIG. 1 is a fragmentary, schematic, perspective view of one embodiment of the brassiere of the present invention.

The brassiere 10 of the present invention includes a pair of three-dimensional bust cups 12, 12 permanently secured together at the front portion of the garment by means of a central panel 14, underbust band assemblies 16, 16, a pair of side panels 18, 18, separable and adjustable fastener means 20 for connecting the side panels generally centrally of the back of a wearer, and shoulder strap assemblies 24, 24.

It is to be understood that the present invention is equally applicable to various other types of brassieres, including front-opening brassieres. Also, the cups 12 may be of substantially any desired configuration and construction.

The marginal inner edges 26 of the cups are secured by stitching to the central panel 14. Each underbust band assembly 16 has an upper marginal edge 30 conforming generally to the curvature of the lower marginal edge 32 of the adjacent cup 12, and stitched thereto, a lower marginal edge 34, an inner marginal edge 36 stitched to the central panel 14 and an outer marginal edge 38 stitched to an adjacent side panel 18. A tape 28 may extend from the apex of each cup to the lower edge 34 of each underbust band assembly 16. Each assembly 16 preferably is formed of elastic power net fabric and oriented such that the elastic stretch and rapid recovery are longitudinally of the brassiere, as shown by the arrows A in FIGS. 1 and 4.

Each side panel 18 is formed of two components 40 and 42 joined by seam 44. The component 40 is somewhat triangular shaped, having a relatively wide lower edge 46 aligned with the lower edge 34 of an assembly 16, a first edge 48 contiguous with edge 38 of assembly 16 and the outer marginal edge 50 of the cup 12 and stitched thereto, a relatively narrow upper edge 52 positioned above the apex of the bra cup and coupled to a shoulder strap 24 by means of ring 54 or other suitable means, and a marginal edge 56, a portion of which is coupled to the edge 58 of component 42 by stitching 44. The component 40 slopes upwardly and inwardly from the component 42 and terminates above the apex of an adjacent cup. Component 40 is formed of an elastic or rigid fabric which converges at a strap end portion to form a direct pull or force on the member 40. The elongation of component 40 is in the directions of arrows B. Note that the shoulder strap is not connected directly to the cup but is secured to the component 40 in spaced relation to the apex of the cup, thereby more vigorously controlling the breast side tissue by removing undesirable bulges.

Figure 4:
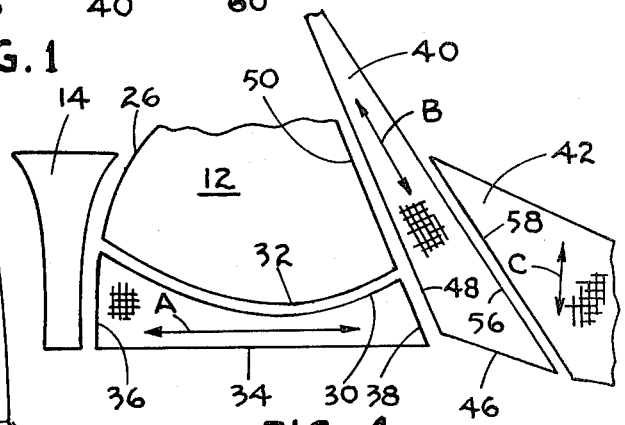
FIG. 4 is a schematic, fragmentary, plan view of various garment components in spaced relation.
Figure 2:
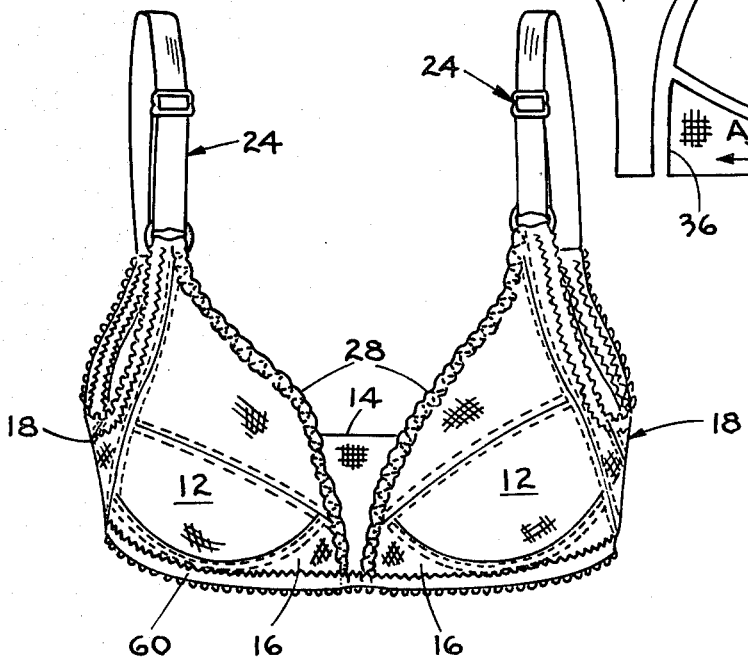
FIG. 2 is a front elevational view of the brassiere illustrating the structure as positioned upon the body of a wearer.
Figure 3:
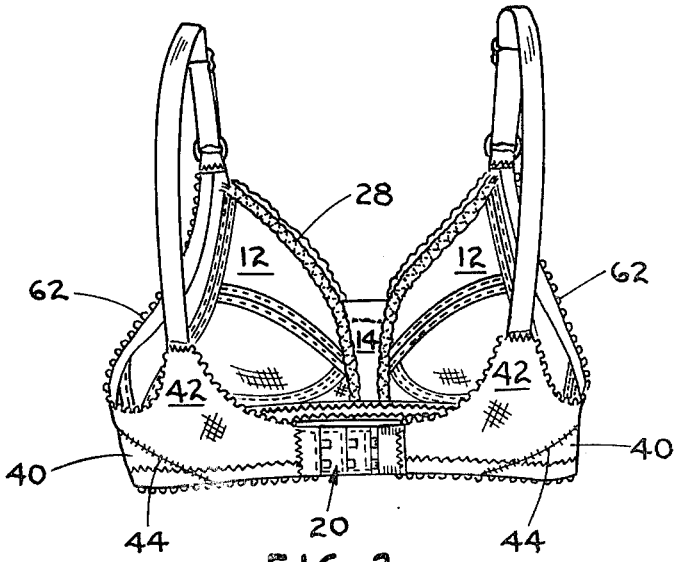
FIG. 3 is a rear elevational view of the brassiere, as worn.

The components 42 of the side panels 18 may be formed of elastic fabric cut in a manner such that the elastic stretch and rapid recovery are in the direction of the arrows C, FIGS. 1 and 4. The components 42, 42 are provided with fastener means 20. The rear portion of each shoulder strap assembly 24 also is secured to a component 42.

An elastic band 60 extends around and is secured to the lower edge portions of assemblies 16, 16 and side panels 18, 18. Elastic binding tapes 62 may also be provided along the upper marginal edges of panel components 40 and 42.

The selected fabric construction and selective angular orientation of components 16, 40 and 42 are such that the direction of pull and recovery is angular, in the direction of arrows B, thus providing characteristics to those areas of the brassiere for evenly distributing stress and essentially flattening bulges of the side breast tissue.

What is claimed is:

1. A brassiere construction comprising a pair of breast receiving cups, means for joining together said cups, a pair of side panel means connected respectively to the outer marginal edges of said pair of cups for securing the brassiere in encircling relation upon a wearer, a pair of shoulder straps, each of said pair of side panel means including first and second components of selected fabric constructions, said first component comprising an elongated, angularly disposed, generally triangular shaped member having a first marginal edge, a portion of which is secured to the outer marginal side edges of an adjacent cup, and a second marginal edge, a portion of which is secured to said second component, said first component first and second marginal edges converging at a location above the apex of an adjacent cup and attached to one of said pair of shoulder straps such that said one shoulder strap applies a directional pull or force directly to said first component, when worn, controlling side breast tissue and eliminating undesirable bulges.

2. A brassiere construction as recited in claim 1, said first component sloping upwardly and inwardly and gradually diminishing in width as it approaches said one shoulder strap to said first component being in a direction generally parallel with the outer marginal edge of an adjacent cup.

3. A brassiere construction as recited in claim 1, and further including band means positioned below and secured to lower marginal edges of said cups, and also having portions secured to said side panel means.

4. A brassiere construction as recited in claim 3, wherein said band means comprises two spaced members connected to said means for joining together said cups and formed of elastic fabric.

5. A brassiere construction as recited in claim 4, wherein said second component is of elastic fabric, the direction of elasticity and rapid recovery of the fabric forming said band means being longitudinally of said brassiere, the direction of elasticity and rapid recovery of the fabric forming said second component being generally perpendicular to that of said band means.

6. A brassiere construction as recited in claim 5, wherein the fabric forming said first component is of elastic material, the direction of elasticity and rapid recovery of said first component being at an angle with respect to the directions of elasticity and rapid recovery of said band means and said second component.

7. A brassiere construction as recited in claim 1, wherein said first component extends from said one of said pair of shoulder straps downwardly and outwardly across the rib cage at an angle when worn.

* * * * *